US006369684B1

(12) United States Patent
Iida et al.

(10) Patent No.: US 6,369,684 B1
(45) Date of Patent: Apr. 9, 2002

(54) VARIABLE INDUCTOR

(75) Inventors: Naoki Iida, Sabae; Masahiko Kawaguchi, Takefu, both of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/496,142

(22) Filed: Feb. 1, 2000

(30) Foreign Application Priority Data

Feb. 2, 1999 (JP) ..... 11-025176

(51) Int. Cl.[7] ..... H01F 5/00

(52) U.S. Cl. ..... 336/200; 336/223; 336/232; 336/137; 29/602.1

(58) Field of Search ..... 336/200, 223, 336/83, 232, 180, 137; 29/602.1, 606, 607

(56) References Cited

U.S. PATENT DOCUMENTS 5,239,289 A * 8/1993 Ferraiolo et al. ..... 336/180

FOREIGN PATENT DOCUMENTS

EP 917162 * 5/1999 ..... 336/200

* cited by examiner

*Primary Examiner*—Anh Mai
(74) *Attorney, Agent, or Firm*—Keating & Bennett, LLP

(57) ABSTRACT

A variable inductor includes a coil and an inductance trimming member disposed on an insulating substrate. The inductance trimming member is disposed outside of an area where the coil is located. By exposing the inductance trimming member to a laser beam, cross rail members of the inductance trimming member are trimmed one by one, thus varying the inductance.

20 Claims, 4 Drawing Sheets

VARIABLE INDUCTOR

BACKGROUND OF THE INVENTION

1. Field of the Invention

The present invention generally relates to variable inductors, and more particularly, relates to variable inductors for use in mobile communications equipment and other such apparatuses.

2. Description of the Related Art

In electronic equipment, and in particular, in mobile communications equipment such as cellular telephones and car telephones, which are required to be miniaturized, the miniaturization of components used in such mobile equipment is also necessary. The higher the operating frequency, the more complicated the circuit configuration is. It is also required that the variation of characteristics of each component be reduced. However, variations do exist among components, so that a circuit including many such components may not function normally. To avoid such a problem, a variable component may be used for the components constituting the circuit. Characteristics of the variable component are adjusted, thus enabling the circuit to function normally. For example, a variable inductor with an inductance adjusting member (trimming pattern) has been used.

FIG. 8 is a perspective view of a conventional variable inductor with an inductance trimming member. An inductor 1 includes a spiral coil 3 on the surface of an insulating substrate 2. The inductance trimming member includes a plurality of electrodes 4 arranged in a ladder configuration. The inductance trimming member is disposed inside of the region where the coil 3 is provided. An end 3*a* of the coil 3 is electrically connected to an external electrode 7. Another end 3*b* of the coil 3 disposed on an insulating film 5 is electrically connected to an external electrode 8. The top surface of the variable inductor 1 is exposed to a laser beam, and the electrodes 4 are trimmed one by one. The inductance value between the external electrodes 7 and 8 is trimmed in a stepwise manner.

FIG. 9 is a perspective view of another conventional variable inductor 11. The inductor 11 includes a spiral coil 13 on the surface of an insulating substrate 12. An inductance trimming member includes leading electrodes 14*a* to 14*d*, which extend from the middle of the coil 13 to the outside of the region where the coil 13 is provided. The leading electrodes 14*c* and 14*d* are disposed on insulating films 15*a* and 15*b*. An end 13*a* of the coil 13 is electrically connected to an external electrode 17. Another end 13*b* of the coil 13 disposed on an insulating film 15*c* is electrically connected to an external electrode 18. The leading electrodes 14*a* to 14*d* are trimmed one by one, so that the inductance value between the external electrodes 17 and 18 is trimmed in stages.

The variable inductor 1 shown in FIG. 8 has the electrodes 4 disposed inside of the region where the coil 3 is provided, and the electrodes 4 interrupt a magnetic field generated by the coil 3. As a result, the Q -value of the inductor 1 is greatly decreased.

The variable inductor 11 shown in FIG. 9 includes the leading electrodes 14*c* and 14*d* opposed to the coil 13 with the insulating films 15*a* and 15*b* disposed therebetween, thus generating stray capacitance therebetween. An increase in the stray capacitance will result in a decrease in the resonance frequency. The trimming of the inductance value of the inductor 11 is performed at every turn, but fails to trim the inductance value precisely. Therefore, it is difficult to use the variable inductors 1 and 11 as trimming components for a high frequency circuit (in particular, a circuit requiring a high Q-value, such as a voltage controlled oscillation circuit).

SUMMARY OF THE INVENTION

In order to overcome the problems described above, preferred embodiments of the present invention provide a variable inductor having a high Q-value for trimming an inductance value.

According to a preferred embodiment of the present invention, there is provided a variable inductor including an insulating substrate, a coil provided on the insulating substrate, an inductance adjusting member provided on the insulating substrate and electrically connected to the coil, the inductance adjusting member is arranged to be trimmed to adjust an inductance value, and an external electrode provided on the insulating substrate, wherein the inductance adjusting member is disposed outside of an area where the coil is located.

The shape of the coil may preferably be spiral, meandering, or helical or other suitable shape.

The inductance adjusting member may be a ladder electrode, which preferably has a substantially L-shaped configuration on the insulating substrate.

Since the inductance adjusting member is disposed outside of the area where the coil is located on the substrate, the degree of interruption in which the inductance adjusting member interrupts a magnetic field generated by the coil is reduced, and an inductor having a high Q-value is obtained. The ladder electrodes of the inductance adjusting member are trimmed or cut one by one, thus trimming the inductance value in a stepwise manner.

For the purpose of illustrating the invention, there is shown in the drawings several forms which are presently preferred, it being understood, however, that the invention is not limited to the precise arrangements and instrumentalities shown.

DETAILED DESCRIPTION OF PREFERRED EMBODIMENTS

Figure 1:
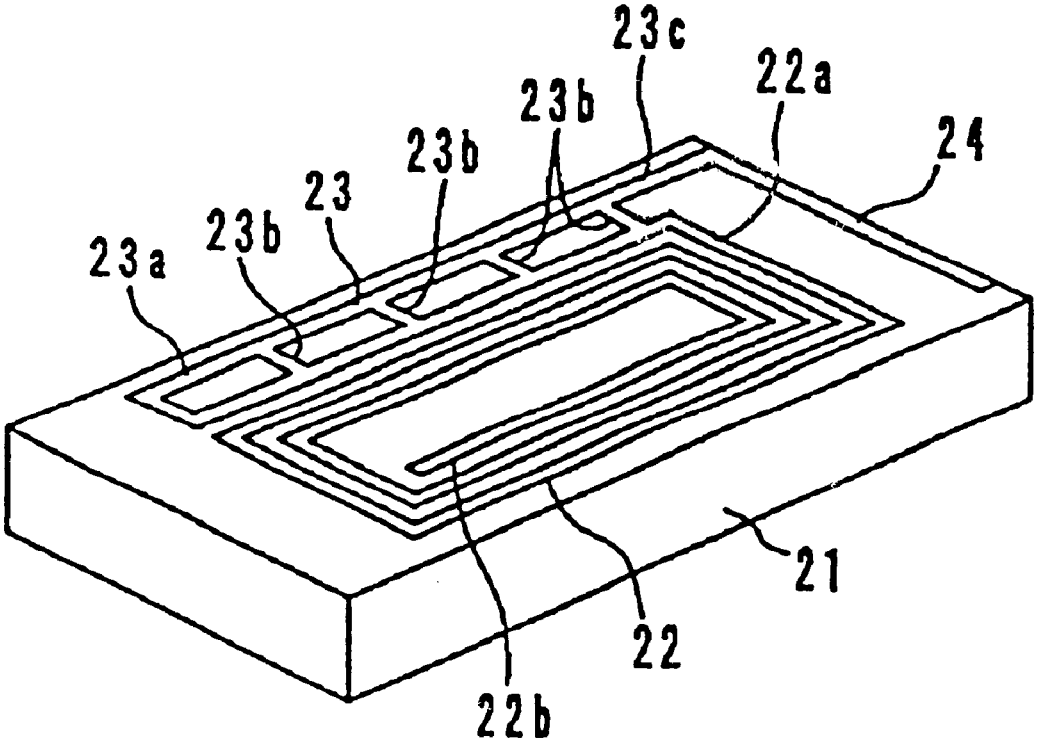
FIG. 1 is a perspective view of a variable inductor according to a first preferred embodiment of the present invention.

Referring to FIG. 1, a variable inductor according to a first preferred embodiment of the present invention is described.

An insulating substrate 21 is polished so that the top surface thereof becomes smooth. A coil 22, an inductance adjusting member 23, and a leading electrode 24 are provided on the top surface of the insulating substrate 21 and are preferably formed via a thick-film screen printing process or a thin-film forming process, e.g., photolithography.

In the thick-film screen printing process, a masking material having apertures with desired patterns and shapes is laid over the top surface of the insulating substrate 21. An electrically conductive paste is applied on the masking material, thus relatively thick-film conductive materials (for example, in the first preferred embodiment, the coil 22, the inductance adjusting member 23, and the leading electrode 24) having desired patterns and shapes are disposed on portions of the top surface of the insulating substrate 21 which are exposed by the apertures of the masking material.

In the photolithography process, a relatively thin-film electrically conductive film is formed substantially over the entire top surface of the insulating substrate 21. A resist film (for example, a photosensitive resin film) is formed substantially over the entirety of the conductive film by spin coating or printing. A mask film with a predetermined image pattern is laid over the top surface of the resist film. A desired portion of the resist film is cured by, for example, exposure to ultraviolet rays. The resist film is then stripped off, leaving the cured portion. The exposed conductive film is removed, and conductive materials (the coil 22, the inductance adjusting member 23, and the leading electrode 24) having desired patterns and shapes are formed thereby. Subsequently, the cured resist film is removed.

Another example of the photolithography process is performed by applying a photosensitive conductive paste on the top surface of the insulating substrate 21 and covering it with a mask film having a predetermined image pattern. The substrate 21 is then exposed and developed.

The coil 22 preferably has a substantially spiral shape. An end 22*a* of the spiral coil 22 is electrically connected to the inductance adjusting member 23. The inductance adjusting member 23 preferably includes a ladder electrode which has a substantially U-shaped frame 23*a* and a plurality of cross rails 23*b* extending across the two arms of the substantially U-shaped frame 23*a*. An end 23*c* of the inductance adjusting member 23 is electrically connected to the leading electrode 24 disposed at the right end of the insulating substrate 21. The inductance adjusting member 23 is disposed outside the area where the coil 22 is located, and is in the vicinity of the coil 22.

As materials for the insulating substrate 21, glass, glass-ceramic, alumina, and ferrite or other suitable material is used. Materials used for the inductance adjusting member 23 and the leading electrode 24 preferably include Ag, Ag—Pd, Cu, Ni, Al or other suitable materials.

Figure 2:
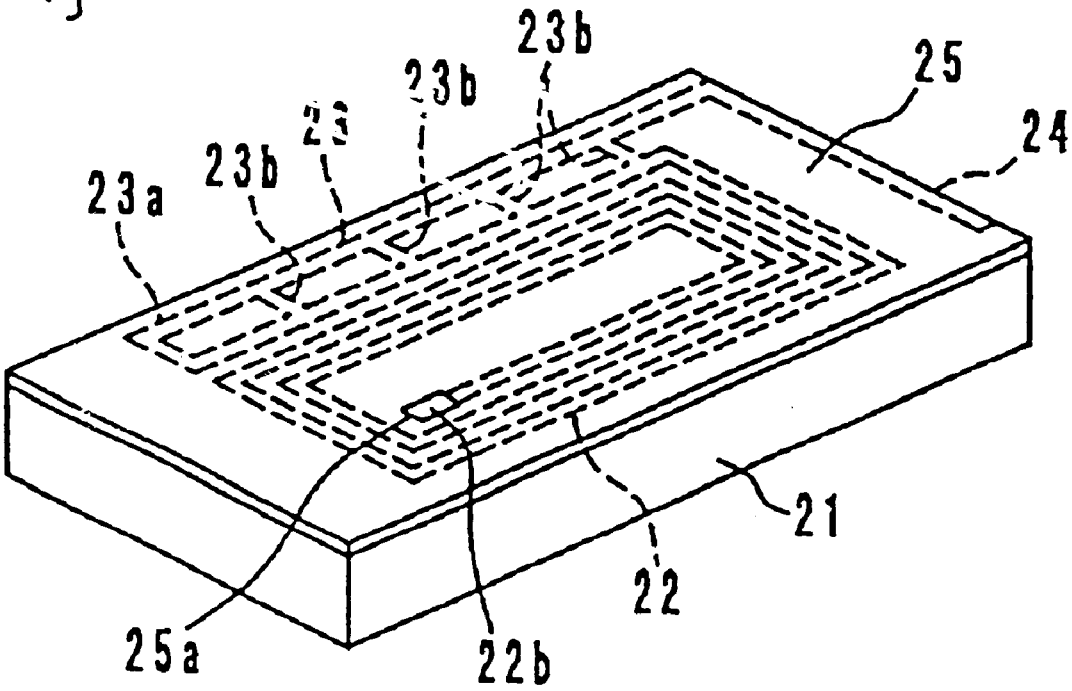
FIG. 2 is a perspective view of the variable inductor for illustrating the manufacturing process after the state shown in FIG. 1.

Referring now to FIG. 2, an insulating protection film 25 with an aperture 25*a* is preferably formed by photolithography. More specifically, a liquid insulating material is applied over the entire top surface of the insulating substrate 21 preferably by spin coating or printing. The liquid insulating material is then dried to form the insulating protection film 25. The insulating material may include a photosensitive polyimide resin or a photosensitive glass paste, which is suitable for photolithography. Next, a mask film with a predetermined image pattern is laid over the top surface of the insulating protection film 25. A desired portion of the insulating protection film 25 is cured by, for example, exposure to ultraviolet rays. Uncured portions of the insulating protection film 25 are removed, thus forming the aperture 25*a*. An end 22*b* located inside of the spiral coil 22 is positioned at the aperture 25*a*.

Figure 3:
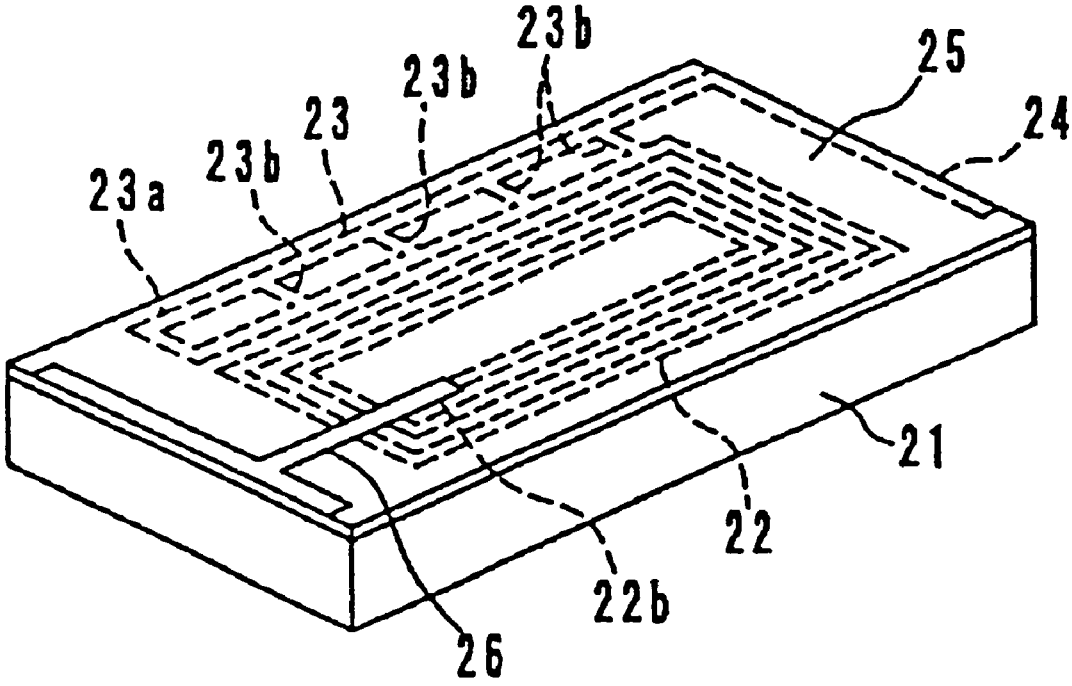
FIG. 3 is a perspective view of the variable inductor for illustrating the manufacturing process after the state shown in FIG. 2.

Turning now to FIG. 3, the leading electrode 26 is formed by the thick-film screening process or the thin-film forming process, e.g., photolithography, as is done for forming the coil 22. The leading electrode 26 is electrically connected via the aperture 25*a* of the insulating protection film 25 to the end 22*b* of the coil 22.

Figure 4:
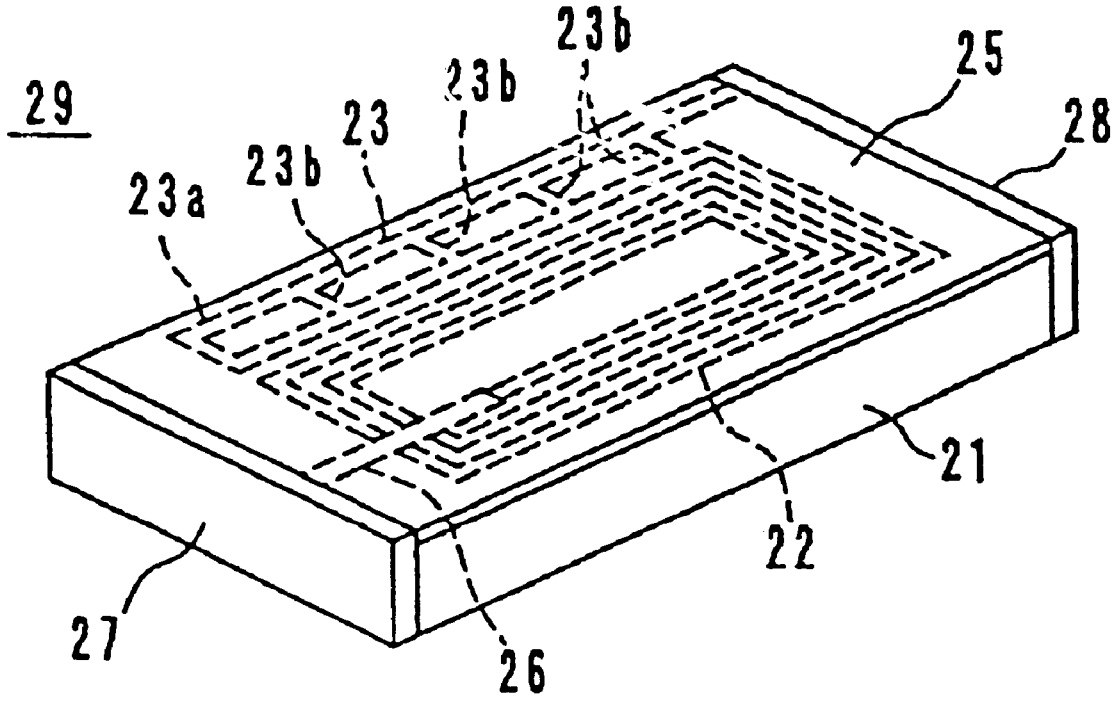
FIG. 4 is an external perspective view of the variable inductor according to preferred embodiments of the present invention.

Referring to FIG. 4, the liquid insulating material is applied over the entire top surface of the insulating substrate 21 preferably by spin coating or printing. The liquid insulating material is then dried to form the insulating protection film 25 covering the leading electrode 26. Next, external electrodes 27 and 28 are formed at opposite ends of the insulating substrate 21 in the longitudinal direction. The external electrode 27 is electrically connected to the leading electrode 26, and the external electrode 28 is electrically connected to the leading electrode 24. The external electrodes 27 and 28 are formed by applying an electrically conductive paste including material such as Ag, Ag—Pd, Cu, NiCr, NiCu, or Ni, and then baking, dry plating, wet plating, or a combination of these methods. Accordingly, a variable inductor 29 is formed in this manner. The variable inductor 29 includes, on the insulating substrate 21, a circuit in which the coil 22 and the inductance adjusting member 23 are electrically connected in series. The inductance adjusting member 23 is disposed on the substrate 21 outside of an area where the coil 22 is located, thereby reducing the degree of interruption in which the inductance adjusting member 23 interrupts a magnetic field generated by the coil 22. Thus, the variable inductor 29 having a high Q-value is achieved.

Figure 5:
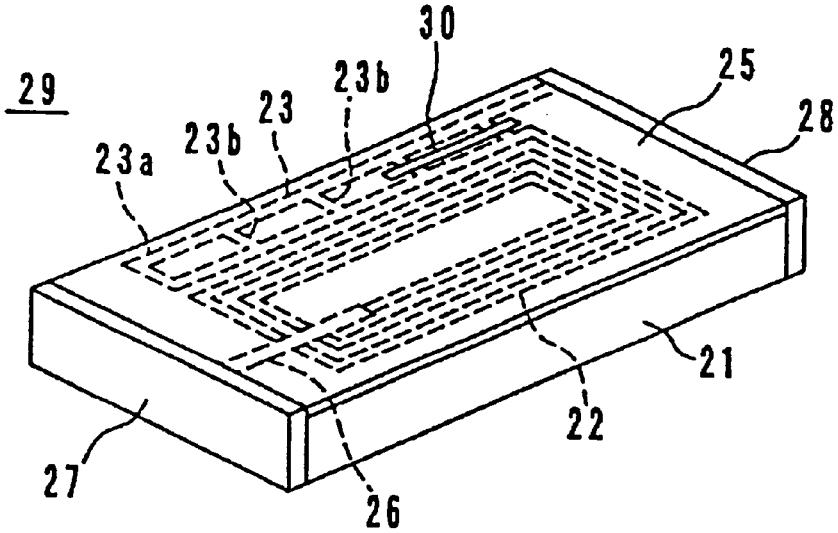
FIG. 5 is a perspective view of the variable inductor shown in FIG. 4 for illustrating an inductance trimming process.

The variable inductor 29 is mounted on a printed board or other substrate, and the inductance adjusting member 23 is trimmed. More specifically, the upper side of the variable inductor 29 is preferably exposed to a laser beam, and a groove 30 is formed in the variable inductor 29, and the cross rails 23*b* of the inductance adjusting member 23 are trimmed one by one, as illustrated in FIG. 5. (FIG. 5 illustrates a condition where two of the cross rails 23*b* are trimmed.) Accordingly, the inductance value between the external electrodes 27 and 28 is gradually varied in a stepwise manner.

The inductance adjusting member 23 may be trimmed, using a device or method other than the laser beam and via any other process which is suitable, such as by a sand blasting process. The groove 30 does not have to be formed in the variable inductor. As long as the cross rails 23*b* are electrically disconnected, the groove 30 is not required to physically exist. When glass or glass-ceramic is used for the insulating protection film 25, the glass melted by the laser beam flows into the trimmed portion, thus forming a protecting film after the trimming. This prevents the electrodes from being exposed after the trimming process.

Figure 6:
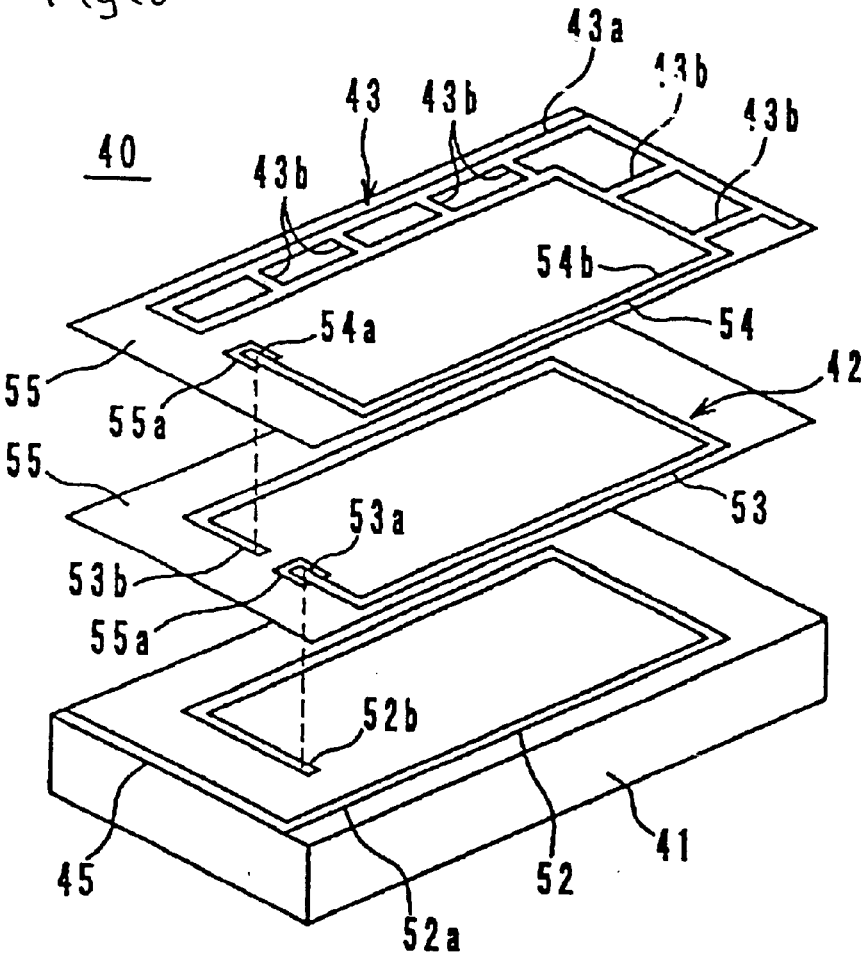
FIG. 6 is a variable inductor according to a second preferred embodiment of the present invention.

Next, a multilayer variable inductor according to a second preferred embodiment of the present invention is described. Referring to FIG. 6, a multilayer variable inductor 40 is constructed by stacking coil conductors 52, 53, and 54 with insulating protection layers 55 disposed therebetween on an insulating substrate 41. The coil conductors 52 to 54 are electrically connected in series to define a substantially helical coil 42. An end 52*a* of the coil conductor 52 is electrically connected to a leading electrode 45. Another end 52*b* of the coil conductor 52 is electrically connected through an aperture 55*a* provided on the insulating protection layer 55 to an end 53*a* of the coil conductor 53. Another end 53*b* of the coil conductor 53 is electrically connected through the aperture 55*a* provided on the insulating protection layer 55 to an end 54*a* of the coil conductor 54. Another end 54*b* of the coil conductor 54 is electrically connected to an inductance adjusting member 43.

The inductance adjusting member 43 is a ladder electrode which preferably includes a frame 43*a* and a plurality of cross rails 43*b* extending across the two substantially L-shaped arms of the frame 43*a*. The substantially L-shaped configuration of the inductance adjusting member 43 increases the range of variability of the inductance value. The inductance adjusting member 43 is disposed outside of an area where the coil 42 is located, and is in the vicinity of the coil 42. The inductance adjusting member 43, the coil conductors 52 to 54, and the insulating protection layer 55 are preferably formed by the thick-film printing process or the thin-film forming process, e.g., photolithography, as illustrated in the first preferred embodiment.

Figure 7:
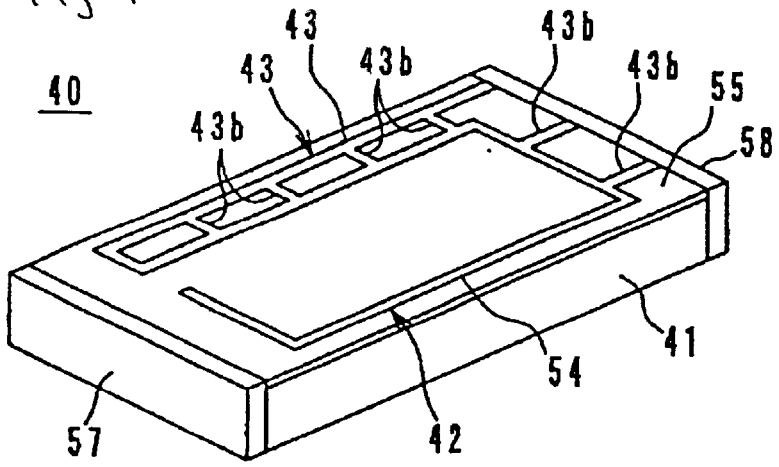
FIG. 7 is an external perspective view of the variable inductor shown in FIG. 6.
Figure 8:
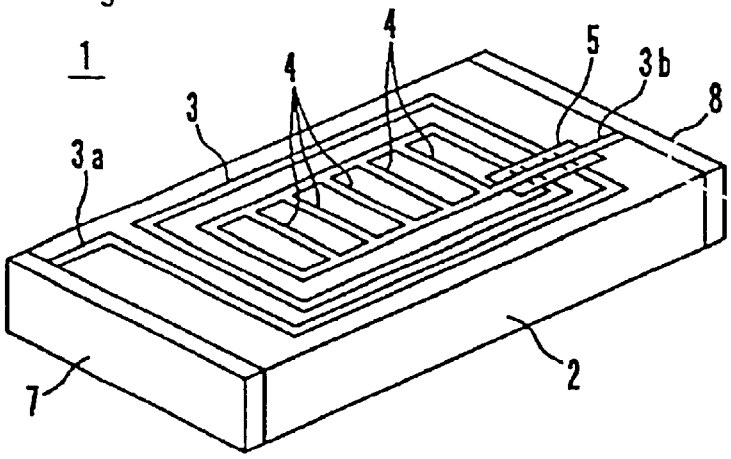
FIG. 8 is a perspective view of a conventional variable inductor.
Figure 9:
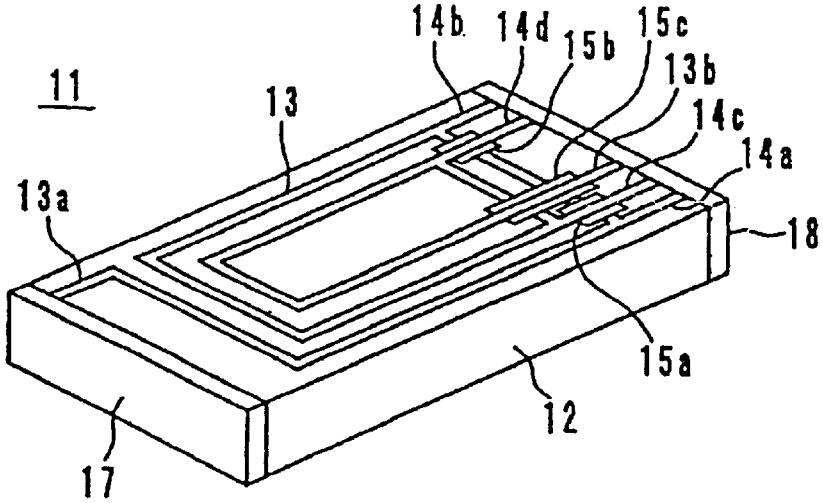
FIG. 9 is a perspective view of another conventional variable inductor.

Turning now to FIG. 7, external electrodes 57 and 58 are provided at both ends of the insulating substrate 42. The external electrode 57 is electrically connected to the leading electrode 45. The external electrode 58 is electrically connected to an end of the frame 43*a* of the inductance adjusting member 43. Although the electrodes, such as the inductance adjusting member 43, are exposed in FIG. 7, it is possible to form another insulating protection film thereover. Accordingly, the multilayer variable inductor 40 is as advantageous as the variable inductor 29 of the first preferred embodiment.

Although the present invention has been described with respect to preferred embodiments, it is to be understood that modifications will be apparent to those skilled in the art without departing from the spirit of the invention.

For example, the inductance adjusting member may have a structure and arrangement other than that of a ladder electrode, and alternatively may be a solid electrode, for example. When a solid electrode is used, the reduction of the electrode may be varied continuously, so that the inductance value is varied continuously. The shape of the coil may be spiral, helical, or meandering or other suitable shape.

The manufacturing process for the multilayer variable inductor is not necessarily limited to the so-called "printing process", i.e., the process of stacking conductive materials and insulating materials one after another to form the multilayer inductor, as in the second preferred embodiment. For example, the so-called "sheet process" may be used. The sheet process is performed by stacking insulating sheets on which via holes for electrically connecting conductor patterns, the coil and the inductance adjusting member, are formed, and then monolithically baking these elements. The insulating sheets may be baked in advance.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A variable inductor comprising:

an insulating substrate;

a coil provided on said insulating substrate;

an inductance adjusting member provided on said insulating substrate and electrically connected to said coil, said inductance adjusting member being arranged to be trimmed to adjust an inductance value of the variable inductor; and an external electrode provided on said insulating substrate;

wherein said inductance adjusting member is disposed outside of an area where said coil is located.

2. A variable inductor according to claim 1, wherein said inductance adjusting member includes a ladder electrode having a substantially L-shaped configuration on said insulating substrate.

3. A variable inductor according to claim 1, wherein said coil has one of a spiral shape, a meandering shape, and a helical shape.

4. A variable inductor according to claim 1, wherein said inductance adjusting member includes a ladder electrode having a substantially U-shaped frame defined by two arms and a plurality of cross rails extending across the two arms of the substantially U-shaped frame.

5. A variable inductor according to claim 1, wherein the insulating substrate is made of at least one of glass, glass-ceramic, alumina, and ferrite.

6. A variable inductor according to claim 1, wherein the inductance adjusting member is made of at least one of Ag, Ag—Pd, Cu, Ni, and Al.

7. A variable inductor according to claim 1, wherein the coil and the inductance adjusting member are electrically connected in series.

8. A variable inductor according to claim 1, wherein the coil includes a plurality of coil conductors stacked on each other on the insulating substrate and a plurality of insulating protection layers between the stacked coil conductors.

9. A variable inductor according to claim 1, wherein the coil conductors are electrically connected to define a substantially helical coil.

10. A method of manufacturing a variable inductor comprising:

providing an insulating substrate;

forming a coil on said insulating substrate;

forming an inductance adjusting member on said insulating substrate so as to be electrically connected to said coil and disposed outside of an area where said coil is located; and trimming the inductance adjusting member to adjust an inductance value of the variable inductor.

11. The method according to claim 10, wherein the step of providing the insulating substrate includes the step of polishing a top surface of the insulating substrate so that the top surface thereof becomes smooth.

12. The method according to claim 10, wherein the step of forming the coil includes one of a thick-film screen printing process and a thin-film forming process.

13. The method according to claim 10, wherein the step of forming the inductance adjusting member includes one of a thick-film screen printing process and a thin-film forming process.

14. The method according to claim 10, further comprising the steps of forming external electrodes on the insulating substrate.

15. The method according to claim 14, wherein the step of forming the external electrodes includes applying an electrically conductive paste including at least one of Ag, Ag—Pd, Cu, NiCr, NiCu, and Ni.

16. The method according to claim 10, wherein the step of trimming the inductance adjusting member includes the steps of exposing the inductance adjusting member to a laser beam and trimming cross rails of the inductance adjusting member one by one.

17. The method according to claim 16, wherein the step of trimming the inductance adjusting member further includes the step of forming a groove in the inductance adjusting member.

18. The method according to claim 10, further comprising the step of forming an insulating protecting film on the insulating substrate so as to cover the coil.

19. The method according to claim 10, further comprising the steps of stacking a plurality of coil conductors on the insulating substrate while stacking a plurality of insulating protection layers between the stacked coil conductors.

20. The method according to claim 19, wherein the coil conductors are electrically connected to define a substantially helical coil.

* * * * *